United States Patent [19]

Caplin

[11] 4,240,378

[45] Dec. 23, 1980

[54] COMBUSTION APPARATUS

[76] Inventor: Peter B. Caplin, Energy House, Olney, Buckinghamshire, England

[21] Appl. No.: 931,974

[22] Filed: Aug. 8, 1978

[30] Foreign Application Priority Data

Aug. 18, 1977 [GB] United Kingdom ..... 34795/77

[51] Int. Cl.[3] ..... B09B 3/00

[52] U.S. Cl. ..... 122/4 D; 122/75

[58] Field of Search ..... 122/75, 76, 496, 4 D

[56] References Cited

U.S. PATENT DOCUMENTS

| | | | |
|---|---|---|---|
| 448,382 | 3/1891 | Stamp | 122/76 |
| 616,380 | 12/1898 | Wernicke | 122/76 |
| 864,358 | 8/1907 | Busler | 122/76 |
| 1,168,728 | 1/1916 | Keith | 122/496 |
| 2,353,168 | 7/1944 | Larson | 122/496 |
| 3,884,193 | 5/1975 | Bryers | 122/4 D |

*Primary Examiner*—Edward G. Favors

[57] ABSTRACT

A boiler having a firebox in which combustion of fuel fed thereto is initiated, a flame tube leading from the firebox in which combustion of fuel may continue and an array of smoke tubes through which the products of combustion issuing from the flame tube are fed to a chimney. The surfaces of the firebox, flame tube and smoke tubes are surrounded by a chamber containing a heat transfer medium, peferably water. A superheater in which steam generated in the chamber is superheated may be included. The superheater is preferably located at the end of the flame tube.

6 Claims, 3 Drawing Figures

COMBUSTION APPARATUS

BACKGROUND OF THE INVENTION

The present invention relates to boilers particularly but not exclusively to shell type boilers.

SUMMARY OF THE INVENTION

According to the present invention a boiler is provided with a firebox in which combustion of fuel fed to the boiler is initiated, a flame tube in which combustion of said fuel may continue and an array of smoke tubes through which the products of combustion issuing from the flame tube are fed to a chimney, the surfaces of the firebox, flame tube and smoke tubes being surrounded by a chamber containing a heat transfer medium.

The flame tube preferably extends in a direction parallel and adjacent to the smoke tubes. The chamber may be formed by a jacket supported relative to the firebox, flame tube and smoke tubes by an array of support members. One or more of said support members may be flexible and/or movable.

The heat transfer medium may be water and the boiler may further include a superheater in which steam generated in said chamber is superheated. Preferably the superheater is located at one end of both the flame tube and the smoke tubes. Advantageously the firebox includes a fluidized bed. The flame tube may also be provided with fluidized bed.

Other aspects of the invention include the provision of a locomotive powered by a boiler as defined above.

BRIEF DESCRIPTION OF THE DRAWINGS

An embodiment of the invention will now be described with reference to the accompanying drawings in which.

DESCRIPTION OF THE INVENTION

Figure 1:
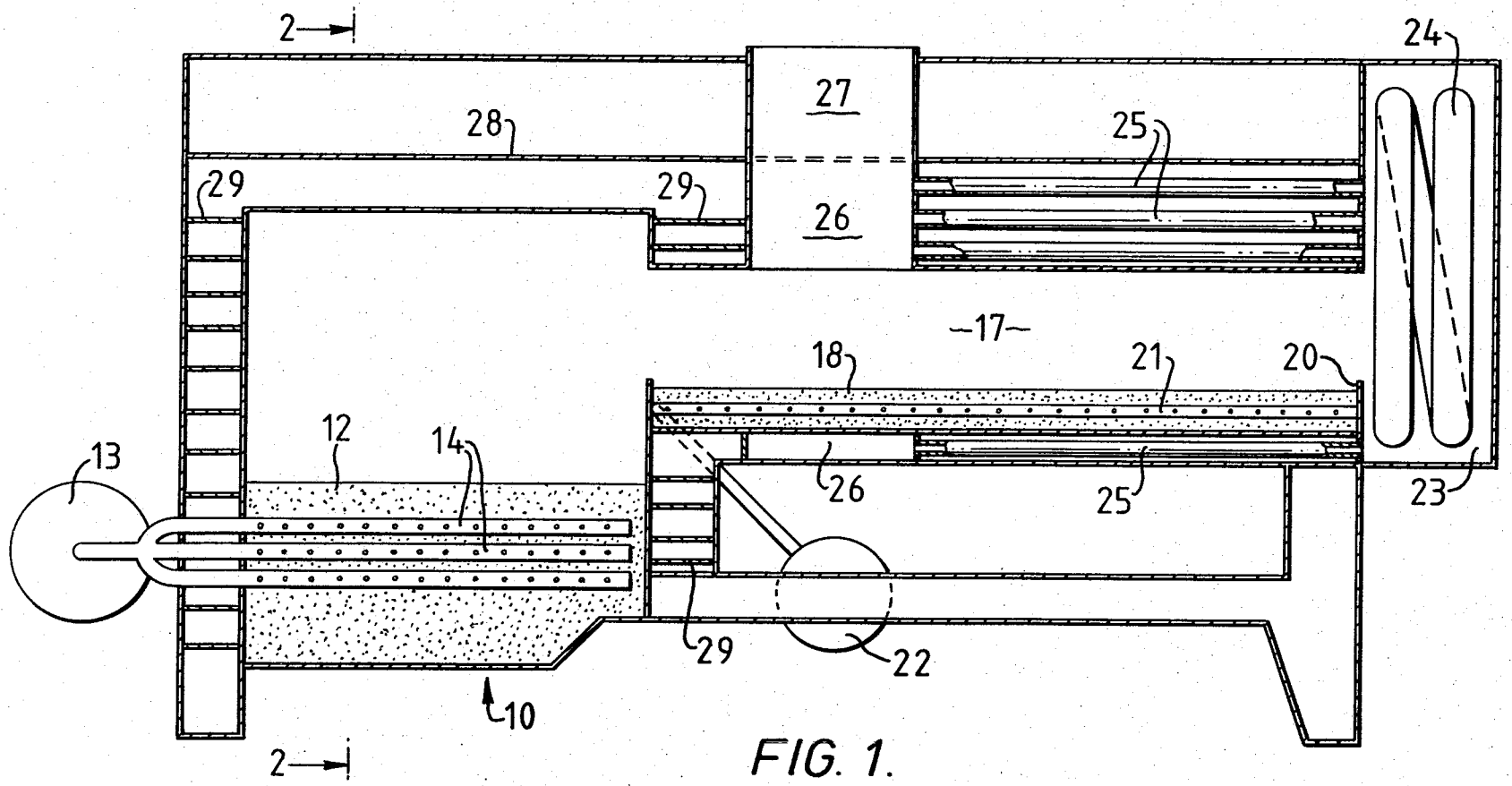
FIG. 1 is a schematic sectional side elevation of a boiler in accordance with the invention.
Figure 2:
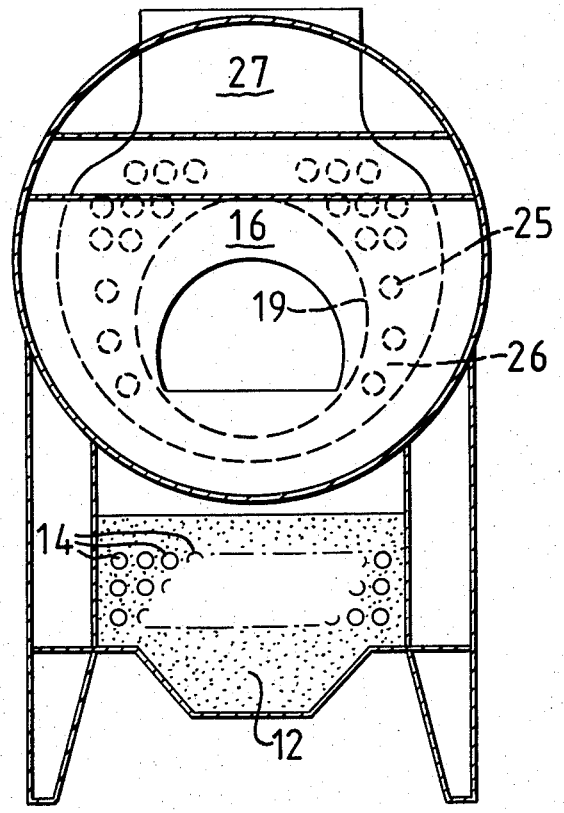
FIG. 2 is a view drawn on the line 11—11 of FIG. 1.

As will be seen the boiler comprises a firebox 10 the side walls of which are capped by a semicircular crown 11 as shown. The bottom of the firebox 10 carries a fluidized bed 12 through which air (from a compressor/preheater 13) and/or fuel may be fed by an array of sparge pipes 14. Any other suitable method may be used to feed air and/or fuel through the fluidized bed.

Primary combustion of fuel fed to the boiler takes place in the volume 15 in the firebox 10 beneath the semicircular crown 11. The volume 15 leads, through an aperture in a throat plate 16, to a flame tube 17 which may include a second fluidized bed 18. The second fluidized bed 18 is contained between the side wall 19 of the flame tube 17, an end wall 20, and the throat plate 16 as shown. The fluidized bed in the flame tube 17 is supplied separately with an air supply by sparge elements (or any other suitable means) 21 from an air supply 22. Combustion of fuel fed to the boiler continues in the flame tube and the products of combustion pass from the flame tube 17, to superheater 23 containing elements 24 producing superheated steam. The superheated steam leaving superheater 23 may be used as desired, for example to drive the blades of a steam turbine or to power a locomotive.

The products of combustion, after passing through the superheater 23, pass through an array of smoke tubes 25 which extend parallel to the flame tube 17 as shown. The smoke tubes 25 terminate in a smoke box 26 which surrounds the flame tube 17 leading to a chimney 27 as shown.

Outside the firebox 10, the flame tubes 17 and smoke tubes 25, a jacket or shell 27 is provided which contains water to be heated by the boiler (for example prior to its transmission to the elements 24 in the superheater 23).

The jacket 27 is supported spaced from the firebox, flame tube and smoke tubes by stays 28, the throat plate 16 and the tube plate 29, as shown. The stays may be rigid although preferably some of them are flexible and/or movable to allow for differential expansion of the jacket and the rest of the boiler.

The air supply to the fluidized bed 18 in the flame tube 17 enables it to burn out any solid particles carried away from the fluidized bed 13 in the firebox 10. This method of providing additional air to the flame tube 17 has the further advantages of firstly preheating the air supplied to the secondary combustion zone in the flame tube and of cooling the bed in the flame tube thereby enabling complete combustion of any products of combustion carried from the firebox 10.

When using a liquid hydrocarbon such as fuel oil it may well be possible to dispense with the use of the second fluidized bed 18 in the flame tube 17. In such a case to ensure that no solid products of combustion pass from the firebox to the flame tube the aperture formed in the throat plate 16 and adjacent flame tube may be provided with an incadescent ceramic baffle which would have the effect of volatizing any non-gaseous products of combustion passing from the firebox to the flame tube.

It will be seen that the particular arrangement described enables a large level of heating of the heat transfer medium to be effected. For example we have found by experiment up to 50% of the heat generated in the firebox 10 may be transmitted through its side walls and semicircular crown to the heat transfer medium. A part of this high level of heat transfer is enabled by the non-angular shape of the crown of the firebox.

The overall high level of heat transfer is effected, mainly by a radiant heat transfer, from the surfaces of the firebox, flame tube and smoke tubes to the heat transfer medium contained in the jacket 27 which totally surrounds these elements of the boiler.

The particular configuration described ensures that heating of the heat transfer medium is at such a level that the temperature of the products of combustion leaving the superheater 23 (and therefore passing into the smoke tubes 25) is relatively low. Combustion gases enter the flame tube at a relatively low speed because of the large diameter of the flame tube compared to the smoke tubes, with the result that the throat plate 16 is not subjected to the high thermal and/or mechanical stresses that would be the case if smaller bore smoke tubes were directly connected to the firebox with the advantageous result that the throat plate and the smoke tubes last longer than would otherwise be the case.

Figure 3:
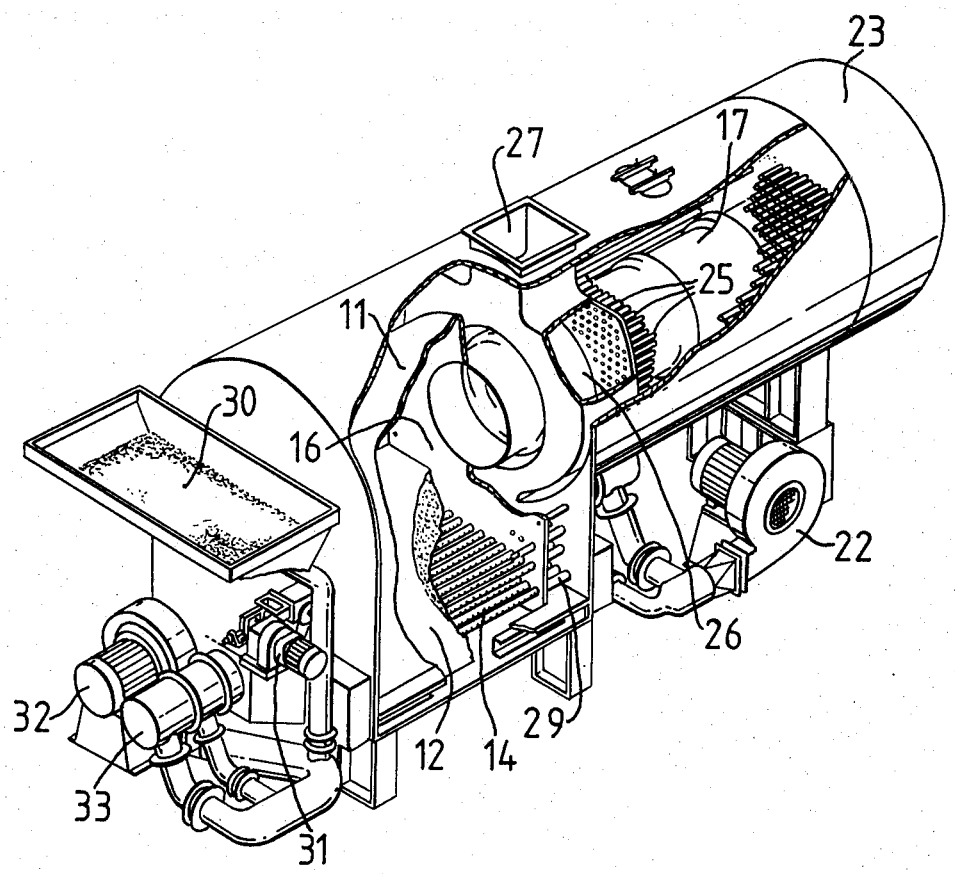
FIG. 3 in a perspective part-cut away view of the boiler.

As shown in FIG. 3 the boiler is arranged to be fed with solid coal fuel from a hopper 30 via a feeder 31. The boiler may in fact be used with any combustable material in either solid or liquid form.

FIG. 3 also shown the compressor/preheater stage in greater detail than FIG. 1. This stage advantageously includes a fan or blower 32 for passing air to the fluidized bed 12 via a pre or trim heater 33. By suitably operating the trim heater it is possible to raise the temperature of the Bed 12 to the optimum operating temperature for the fuel being used rapdily. The trim heater 33 may be turned off (or its output may be reduced) as soon as the bed 12 has reached its optimum operating temperature.

Various modifications may be made to the design described without departing from the scope of the present invention; for example the fluidized bed in the bottom of the firebox 10 may be formed in two parts with a differential air supply to each part enabling any solid particles which are not combustible to fall through the fluidized bed and be extracted from the bottom of it.

Particular advantages of the present design include the fact that there is low thermal stress on the throat plate 16, and has a far greater heat transfer from the firebox to the surrounding jacket enabling the high output boiler to be provided in a relatively small size. With the particular arrangement described it is possible to provide a boiler having an overall length of some 30 feet and a diameter of some 8 to 10 feet which is sufficiently small to be provided as a locomotive boiler.

What we claim is:

1. A boiler comprising a firebox to which fuel is fed having a fluidized combustion bed to which a supply of air under pressure is fed to initiate and sustain combustion, an elongated flame tube extending from said fire box and communicating at one end therewith in which combustion of said fuel may continue, an array of smoke tubes concentricly located about said flame tube and extending parallel thereto, the other end of said flame tube and the adjacent ends of said smoke tubes communicating with a chamber so that the products of combustion issuing from the flame tube are fed thereto, the free ends of said smoke tubes communicating with a chimney for exhaust and a water jacket surrounding said firebox, flame tube and smoke tubes, a superheater located within said chamber and communicating with said water jacket for the generation of superheated steam.

2. A boiler comprising a firebox to which fuel is fed having a fluidized combustion bed to which a supply of air under pressure is fed to initiate and sustain combustion, an elongated flame tube extending from said fire box and communicating at one end therewith in which combustion of said fuel may continue, an array of smoke tubes located adjacent said flame tube and extending parallel thereto, the other end of said flame tube and the adjacent ends of said smoke tubes communicating so that products of combustion issuing from the flame tube are fed thereto, the free ends of said smoke tube communicating with a chimney for exhaust, a water jacket surrounding said firebox, flame tube and smoke tubes, said flame tube being provided with a fluidized bed and further air supply means operable to supply air to said fluidized bed in said flame tube to fluidize the material of the bed and support combustion of combustible material passed thereto from the firebox.

3. A boiler comprising a firebox to which fuel is fed having a fluidized combustion bed to which a supply of air under pressure is fed to initiate and sustain combustion, an elongated flame tube extending from said fire box and communicating at one end therewith in which combustion of said fuel may continue, an array of smoke tubes located adjacent said flame tube and extending parallel thereto, the other end of said flame tube and the adjacent ends of said smoke tubes communicating so that products of combustion issuing from the flame tube are fed thereto, the free ends of said smoke tube communicating with a chimney for exhaust, a water jacket surrounding said firebox, flame tube and smoke tubes, said end of the flame tube communicating with the firebox being provided with an incandescent ceramic baffle in which solids passing from the firebox are volatized.

4. A boiler as claimed in claim 2 including means for passing air to said fluidized beds.

5. A boiler as claimed in claim 2 wherein that end of the flame tube adjacent the firebox is provided with an incandescent ceramic baffle in which solids passing from the firebox are volatized.

6. A locomotive boiler comprising in combination; a firebox in which combustion of fuel fed to the boiler is initiated, a flame tube in which combustion of said fuel may continue, an array of smoke tubes extending in a direction parallel to and adjacent said flame tube through which the products of combustion issuing from the flame tube are fed to a chimney, the surfaces of the firebox, flame tube and smoke tubes being surrounded by a chamber containing water, said firebox defining a fluidized bed, and means supplying air to said fluidized bed to fluidize the material of the bed and support combustion of fuel fed to the firebox, in which the flame tube is provided with a fluidized bed, and in which a further air supply means are provided operable to supply air to said flame tube fluidized bed to fluidize the material of that bed and to support combustion of combustible material passed thereto from said firebox.

* * * * *